US010306716B1

(12) United States Patent
Lin

(10) Patent No.: US 10,306,716 B1
(45) Date of Patent: May 28, 2019

(54) CONTROL SIGNAL SWITCHING SYSTEM

(71) Applicant: THERMALTAKE TECHNOLOGY CO., LTD., Taipei (TW)

(72) Inventor: Pei-Hsi Lin, Taipei (TW)

(73) Assignee: THERMALTAKE TECHNOLOGY CO., LTD. (TW)

( * ) Notice: Subject to any disclaimer, the term of this patent is extended or adjusted under 35 U.S.C. 154(b) by 0 days.

(21) Appl. No.: 16/102,866

(22) Filed: Aug. 14, 2018

(30) Foreign Application Priority Data

Jun. 1, 2018 (TW) ..... 107207351 U

(51) Int. Cl.
*H05B 33/08* (2006.01)

(52) U.S. Cl.
CPC ..... *H05B 33/0815* (2013.01); *H05B 33/0842* (2013.01)

(58) Field of Classification Search
CPC .... H05B 33/02; H05B 33/08; H05B 33/0815; H05B 33/0842; H05B 37/02
See application file for complete search history.

(56) References Cited

U.S. PATENT DOCUMENTS 8,664,875 B1 * 3/2014 Chang ..... H05B 33/0842 315/224
2004/0122930 A1 * 6/2004 Pasternak ..... H04L 12/2803 709/223
2005/0179404 A1 * 8/2005 Veskovic ..... H05B 37/0254 315/291
2006/0125426 A1 * 6/2006 Veskovic ..... H05B 37/0254 315/312
2008/0192767 A1 * 8/2008 Howe ..... H05B 37/0254 370/449
2008/0315798 A1 * 12/2008 Diederiks ..... H05B 33/0863 315/312
2011/0140611 A1 * 6/2011 Elek ..... H05B 37/0272 315/130
2013/0141011 A1 * 6/2013 Fushimi ..... H05B 37/02 315/294
2013/0271004 A1 * 10/2013 Min ..... H05B 33/0842 315/112
2014/0354178 A1 * 12/2014 Siessegger ..... H05B 33/0806 315/294

* cited by examiner

*Primary Examiner* — Jason Crawford
(74) *Attorney, Agent, or Firm* — Schmeiser, Olsen & Watts, LLP

(57) ABSTRACT

A control signal switching system generates a light emitting module control signal for controlling a light emitting module, and the control signal switching system has a switching module and a transmission module. The switching module receives a switching control signal, a first control signal and a second control signal and output one control signal selected from the first control signal and the second control signal according to the switching control signal. The transmission module is connected to the switching module for receiving the one control signal selected from the first control signal and the second control signal and generates the light emitting module control signal for transmitting to the light emitting module. Therefore, the light emitting module is in operation according to the light emitting module control signal.

8 Claims, 2 Drawing Sheets

CONTROL SIGNAL SWITCHING SYSTEM

CROSS-REFERENCE TO RELATED APPLICATION

This non-provisional application claims priority under 35 U.S.C. § 119(a) on Patent Application No(s). 107207351 filed in Taiwan, R.O.C. on Jun. 1, 2018, the entire contents of which are hereby incorporated by reference.

TECHNICAL FIELD

The present disclosure relates to a control signal switching system, and more particularly, to a control signal switching system for a light emitting module.

RELATED ART

Power supplies are used to provide power to computer devices which need the power to work, for example, the power is provided to motherboards, hard disks, displays card and sound cards, which are installed in the computer device. In recent years, to provide novel user experiences, power supplies are configured to have multiple light emitting units arranged in different positions. Therefore, the power supplies can provide various light effects to users when working.

However, conventional power supplies only have simple switching functions for switching different light emitting modes, and the light emitting modes of the power supplies cannot switched by other devices or apparatuses. Thus, it causes user inconvenience of switching the light emitting modes. In addition, being limited by the simple switching functions, users cannot customize the desired or unique light emitting mode, and the finite light emitting modes of the power supplies are repeatedly used. Therefore, the users may feel bored and have a poor watching experiences, when watching scenarios of the finite and repeated light emitting modes.

SUMMARY

An objective of the present disclosure is to provide a control signal switching system for switching and selecting one control signal among multiple control signals that come from different sources according to a condition and controlling a light emitting module according to the selected control signal. A user can customize the control signal, and the light emitting module can emit light according to the user customized control signal, thus resulting an unique light effect to increase a user watching experience.

To achieve at least the above objective, the present disclosure provides a control signal switching system for generating a light emitting module control signal for controlling a light emitting module, and the control signal switching system has a switching module and a transmission module. The switching module receives a first control signal, a second control signal and a switching control signal, and outputs one of the first control signal and the second control signal according to the switching control signal. The transmission module is connected to the switching module, receives one of the first control signal and the second control signal outputted by the switching module, and generates the light emitting module control signal transmitted to the light emitting module, such that the light emitting module performs an operation according to the light emitting module control signal.

In an embodiment of the present disclosure, the control signal switching system further has a switching control signal generation unit connected to the switching module, and the switching control signal generation unit generates the switching control signal according to a switching condition.

In an embodiment of the present disclosure, the control signal switching system further has a first signal input unit connected to the switching module, and the first signal input unit generates the switching control signal according to an operation performed of a user.

In an embodiment of the present disclosure, the control signal switching system has a second signal input unit and a decision module. The second signal input unit generates a sensing signal according to the operation performed by the user. The decision module is connected to the second signal input unit and the switching module, receives the sensing signal, and generates the first control signal according to the sensing signal.

In an embodiment of the present disclosure, the control signal switching system has a first connection port connected to the switching module, and the first connection port receives the second control signal and transmits the second control signal to the switching module.

In an embodiment of the present disclosure, the control signal switching system has a second connection port and a wireless communication module. The second connection port is connected to the switching module, and the second connection port receives a third control signal and transmits the third control signal to the switching module. The wireless communication module is connected to the second connection port, and the wireless communication module receives the third control signal wirelessly and transmits the third control signal to the second connection port.

DETAILED DESCRIPTION OF THE PREFERRED EMBODIMENTS

To make it easier for the examiner to understand the objects, characteristics and effects of this present disclosure, embodiments together with the attached drawings for the detailed description of the present disclosure are provided.

Figure 1:
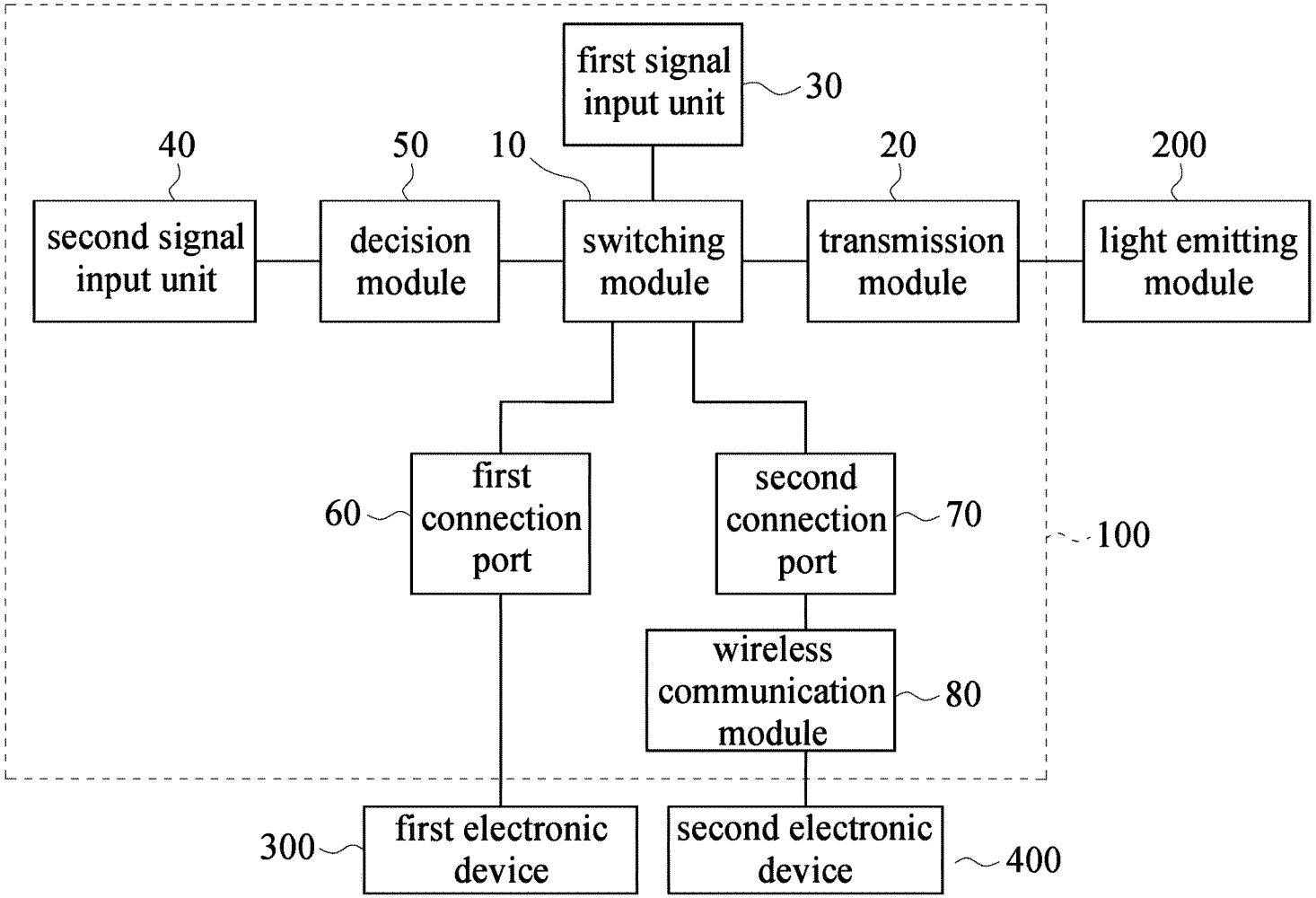
FIG. 1 is a schematic diagram of a control signal switching system according to an embodiment of the present disclosure.

Please refer to FIG. 1, and FIG. 1 is a schematic diagram of a control signal switching system 100 according to an embodiment of the present disclosure. The control signal switching system 100 is connected to a light emitting module 200, a first electronic device 300 and a second electronic device 400 in wired or wireless manner. The light emitting module 200 is implemented by a light emission diode (LED) strip or a LED fan, and the present disclosure is not limited thereto.

According to one of a first control signal, a second control signal and a third control signal, the control signal switching system 100 generates a light emitting module control signal for controlling the light emitting module 200. The light emitting module 200 controls a plurality of light emitting units (for example, the light emitting units of the LED strip) according to the light emitting module control signal. The light emitting units emits lights with different light colors, brightness or light emitting modes according to the light emitting module control signal. The light emitting mode is a monochromatic light emitting mode, a multi-color emitting mode, a flashing light emitting mode, a constant lighting mode or a breathing light emitting mode, and the present disclosure is not limited thereto.

In the embodiment, the control signal switching system 100 has a switching module 10, a transmission module 20, a first signal input unit 30, a second signal input unit 40, a decision module 50, a first connection port 60, a second connection port 70 and a wireless communication module 80.

The first signal input unit 30 is connected to the switching module 10 and generates a switching control signal according to an operation performed by a user. The first signal input unit 30 is a miniature pushbutton switch and the present disclosure is not limited thereto. For example, the user pushes the first signal input unit 30 in a hold down manner or a one-click manner, the first signal input unit 30 generates a sensing signal according to the push operation performed by the user, and the sensing signal acting as the switching control signal is transmitted to the switching module 10.

The second signal input unit 40 is connected to the decision module 50 and generates the sensing signal according to the operation performed by the user. The second signal input unit 40 is a miniature pushbutton switch and the present disclosure is not limited thereto. For example, the user pushes the second signal input unit 40 in a hold down manner or a one-click manner, and the second signal input unit 40 generates the sensing signal according to the push operation performed by the user and transmits the sensing signal to the decision module 50.

The decision module 50 is further connected to the switching module 10. The decision module 50 receives the sensing signal generated by the second signal input unit 40, generates the first control signal according to the sensing signal, and transmits the first control signal to the switching module 10. More specifically, the decision module 50 sequentially switches a plurality of sub control signals of the decision module 50 according to the sensing signal (for example, switching from a first sub control signal to a second sub control signal) and generates the first control signal according to the sub control signal which is selected in response to the sensing signal, and each of the sub control signal has information of a light color, a brightness and a light emitting mode.

The first connection port 60 is connected to the switching module 10 and the first electronic device 300, receives the second control signal transmitted by the first electronic device 300, and transmits the second control signal to the switching module 10. The first connection port 60 can be an USB (Universal Serial Bus) and the present disclosure is not limited thereto.

The first electronic device 300 displays an operation screen corresponding to the control signal switching system 100. The user uses an input unit (such as a mouse, a keyboard and/or a touch screen) of the first electronic device 300 to input the information (i.e. the light color, the brightness and the light emitting mode) in the operation screen, so as to control the light emitting module 200. The first electronic device 300 generates the second control signal according to the information (i.e. the light color, the brightness and the light emitting mode). The first electronic device 300 is a desktop computer or a laptop computer, and the present disclosure is not limited thereto.

The second connection port 70 is connected to the switching module 10 and the wireless communication module 80. The second connection port 70 receives the third control signal transmitted by the wireless communication module 80 and transmits the third control signal to the switching module 10. The second connection port 70 is an USB (Universal Serial Bus) and the present disclosure is not limited thereto.

The wireless communication module 80 is a communication circuit that conforms to a Wireless LAN Protocol, a Bluetooth Protocol or an Infrared communication protocol, and the present disclosure is not limited thereto. The wireless communication module 80 is communication connected to the second electronic device 400 wirelessly, so as to receive the third control signal transmitted by the second electronic device 400, and to transmit the third control signal to the second connection port 70.

The second electronic device 400 displays the operation screen corresponding to the control signal switching system 100. The user uses an input unit (for example, a touch screen) of the second electronic device 400 to inputs the information (i.e. the light color, the brightness and the light emitting mode) in the operation screen, so as to control the light emitting module 200. The second electronic device 400 generates the third control signal according to the information (i.e. the light color, the brightness and the light emitting). The second electronic device 400 is a smart phone or a tablet computer, and the present disclosure is not limited thereto.

The switching module 10 receives the switching control signal, the first control, the second control signal and the third control signal, and according to the switching control signal, the switching module 10 selects and transmits one of the first control, the second control signal and the third control signal to the transmission module 20. More precisely, the switching module 10 switches the first control signal, the second control signal and the third control signal and selects one control signal from the first control signal, the second control signal and the third control signal according to the switching control signal. For example, when the switching control signal indicates that the first control signal is selected, and the switching module 10 received the first control signal, the second control signal and the third control signal simultaneously, the switching module 10 transmits the first control signal to the transmission module 20.

The transmission module 20 is connected to the switching module 10. The transmission module 20 receives the first, second or third control signals transmitted by the switching module 10 and generates the light emitting module control signal transmitted to the light emitting module 200. Therefore, the light emitting module 200 can perform the operation corresponding to the light emitting module control signal. For example, the transmission module 20 receives the first control signal transmitted by switching module 10 and generates the light emitting module control signal according to the light color (for example, the light color is red), the brightness (for example, the brightness is 250 grayscale values) and the light emitting mode (for example, the emitting mode is constant lighting mode) of the first control signal. The transmission module 20 further transmits the light emitting module control signal to the light emitting module 200, so the light emitting module 200 can control the red emitting units to emit the red light with 250 grayscale values under the constant lighting mode.

In the embodiment, the switching module 10, the transmission module 20, the decision module 50, the first connection port 60 and the second connection port 70 may be disposed at a PCB (printed circuit board), the switching 10, the transmission module 20 and the decision module 50 can be implemented by an IC (integrated circuit) or a chip, and the present disclosure is not limited thereto.

Figure 2:
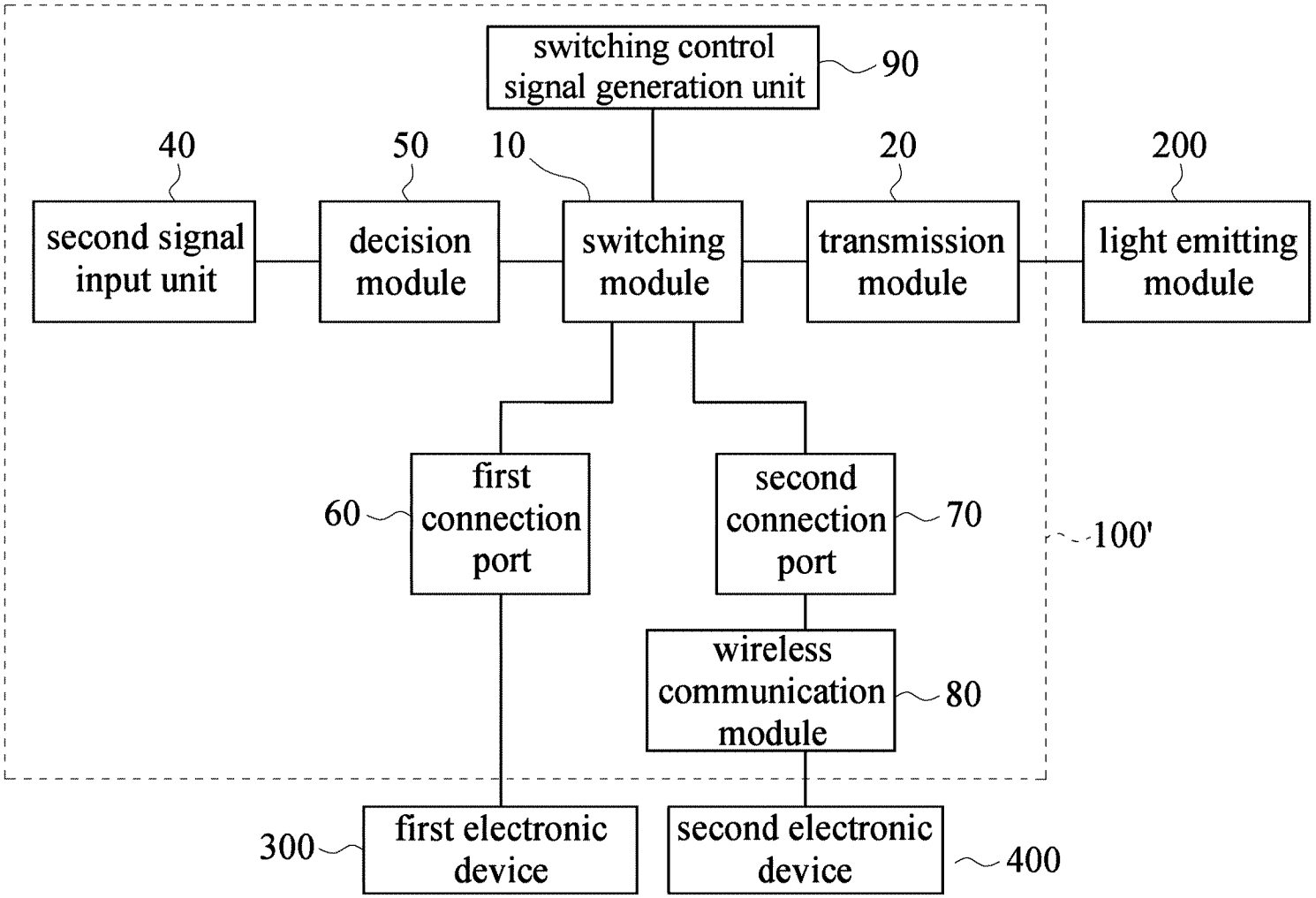
FIG. 2 is a schematic diagram of a control signal switching system according to another embodiment of the present disclosure.

Please refer to FIG. 2, and FIG. 2 is a schematic diagram of a control signal switching system 100' according to another embodiment of the present disclosure. In FIG. 2 and FIG. 1, elements having the same reference numerals are the same elements, and therefore the redundant descriptions thereof are omitted. The difference between FIG. 2 and FIG. 1 is that the control signal switching system 100' has a switching control signal generation unit 90 for generating the switching control signal.

The switching control signal generation unit 90, according to a switching condition, generates the switching control signal having the switching condition, and then transmits the switching control signal to the switching module 10. The switching condition is an information of a preset priority, a user customized priority or user selected one of the control signals (the first control signal, the second control signal or the third control signal).

In an embodiment, the switching condition is the preset priority of the control signals, the priority of the first control signal is greater than the second control signal and the priority of the second control signal is greater than the third control signal, and the present disclosure is not limited thereto. When the switching module 10 receives the first control signal and the second control signal at same time, the switching module 10 selects and transmits the first control signal to the transmission module 20 according to the preset priority which specifies the priority of the first control signal is greater than the priority of the second control signal.

In another embodiment, the switching condition is the information that the second control signal is selected by the user. When the switching module 10 receives the first control signal and the second control signal at same time, the switching module 10 selects and transmits the second control signal to the transmission module 20 according to the switching condition.

In the embodiment, by using the operation screen (for example, the operation screen of application program) corresponding to the switching control signal generation unit 90 and input unit, the first electronic device 300 or the second electronic device 400 can be used to edit the user customized priority or the information of the control signal selected by the user, and the present disclosure is not limited thereto.

In another embodiment, the switching control signal generation unit 90 is installed in the switching module 10. For example, a firmware corresponding to the switching control signal generation unit 90 is programmed in the switching module 10 implemented by a chip, and the present disclosure is not limited thereto. Moreover, in the embodiment, the switching condition may only be the preset priority.

In summary, the control signal switching system 100 of the present disclosure comprises the second signal input unit 40, the first connection port 60, the second connection port 70 and the wireless communication module 80, so that the control signal switching system 100 of the present disclosure is suitable for different input devices for inputting the control signals. In addition to the flexible selection of suitable control signal sources according to the environment, users can also choose different methods for inputting control signals according to their needs or preferences. In addition, user can easily switch the light emitting effect of the light emitting module 200 by using the control signal switching system 100, and customize different light colors, brightness and light emitting modes of the light emitting units, thus increasing the user watching experience.

While the present disclosure has been described by means of specific embodiments, numerous modifications and variations could be made thereto by those skilled in the art without departing from the scope and spirit of the present disclosure set forth in the claims.

What is claimed is:

1. A control signal switching system generating a light emitting module control signal for controlling a light emitting module, comprising:

a switching control signal generation unit, generating a switching control signal according to a switching condition for selecting one control signal from a plurality of control signals;

a switching module, receiving a first control signal and a second control signal simultaneously, and outputting a selected control signal selected from the first control signal and the second control signal according to the switching control signal; and a transmission module, connected to the switching module, receiving the selected control signal outputted by the switching module and generating the light emitting module control signal transmitted to the light emitting module, such that the light emitting module performs an operation according to the light emitting module control signal.

2. The control signal switching system according to claim 1, wherein the switching condition is a preset priority of the switching control signal generation unit.

3. The control signal switching system according to claim 1, wherein the switching condition is a user customized priority or information of user selected one of the first control signal and the second control signal.

4. The control signal switching system according to claim 1, further comprising:

a second signal input unit, generating a sensing signal according to an operation performed by a user; and a decision module, connected to the second signal input unit and the switching module, receiving the sensing signal, and generating the first control signal according to the sensing signal.

5. The control signal switching system according to claim 1, further comprising:

a first connection port, connected to the switching module, receiving the second control signal and transmitting the second control signal to the switching module.

6. The control signal switching system according to claim 5, further comprising:

a second connection port, connected to the switching module, receiving a third control signal and transmitting the third control signal to the switching module.

7. The control signal switching system according to claim 6, further comprising:

a wireless communication, connected to the second connection port, receiving the third control signal wirelessly and transmitting the third control signal to the second connection port.

8. The control signal switching system according to claim 1, wherein each of the first control signal and the second control signal comprises information of a light color, a brightness and a light emitting mode.

* * * * *